US011026457B1

(12) United States Patent
Mayer

(10) Patent No.: US 11,026,457 B1
(45) Date of Patent: Jun. 8, 2021

(54) CONCEALED POCKET SYSTEM

(71) Applicant: Charles J. Mayer, Fitchburg, MA (US)

(72) Inventor: Charles J. Mayer, Fitchburg, MA (US)

( * ) Notice: Subject to any disclaimer, the term of this patent is extended or adjusted under 35 U.S.C. 154(b) by 698 days.

(21) Appl. No.: 15/653,193

(22) Filed: Jul. 18, 2017

Related U.S. Application Data

(63) Continuation-in-part of application No. 14/989,111, filed on Jan. 6, 2016, now abandoned, which is a continuation-in-part of application No. 13/627,234, filed on Sep. 26, 2012, now abandoned, which is a continuation-in-part of application No. 12/775,434, filed on May 6, 2010, now abandoned.

(51) Int. Cl.
*A41D 27/20* (2006.01)
*A41D 3/00* (2006.01)

(52) U.S. Cl.
CPC ..... *A41D 27/201* (2013.01); *A41D 3/005* (2013.01)

(58) Field of Classification Search
CPC .... A41D 27/201; A41D 3/005; A41D 27/202; A41D 27/20
USPC ..... 2/247, 84
See application file for complete search history.

(56) References Cited

U.S. PATENT DOCUMENTS

| | | | | |
|---|---|---|---|---|
| 2,544,840 | A | 3/1951 | Kowatsch | |
| 2,755,480 | A | 7/1956 | Jones et al. | |
| D261,070 | S | 10/1981 | Pettibone | |
| 4,404,687 | A | 9/1983 | Hager | |
| 4,464,798 | A * | 8/1984 | Livingstone | A41D 27/20 2/247 |
| 4,497,071 | A | 2/1985 | Bell | |
| 4,569,089 | A | 2/1986 | Nesse | |
| 4,573,218 | A | 3/1986 | Saggs | |
| 4,860,388 | A | 8/1989 | Dean | |
| 5,101,513 | A | 4/1992 | Bowers | |
| 5,255,392 | A | 10/1993 | Stainslaw | |
| 5,611,083 | A | 3/1997 | Arnold | |
| 6,237,152 | B1 * | 5/2001 | Gootrad | A41D 13/012 2/108 |
| 6,848,118 | B2 | 2/2005 | Barnes et al. | |
| 7,296,303 | B1 | 11/2007 | Samet | |
| D627,540 | S | 11/2010 | Claeys | |
| 2002/0124296 | A1 | 9/2002 | Lipsett et al. | |
| 2005/0235398 | A1 | 10/2005 | Yoo | |
| 2007/0266473 | A1 | 11/2007 | Issel | |
| 2008/0196140 | A1 | 8/2008 | Mayerson et al. | |
| 2009/0049580 | A1 | 2/2009 | Wilson | |
| 2009/0158493 | A1 | 6/2009 | Kim | |
| 2009/0282600 | A1 * | 11/2009 | Robinson | A41D 27/20 2/79 |
| 2009/0293170 | A1 | 12/2009 | Kiker | |
| 2011/0185471 | A1 * | 8/2011 | Buczkowski | A41D 27/20 2/84 |

* cited by examiner

*Primary Examiner* — Khoa D Huynh
*Assistant Examiner* — Abby M Spatz

(57) ABSTRACT

A concealed pocket system is described herein. The concealed pocket system has a concealed pouch assembly disposed on a clothing garment. A concealed pocket of the concealed pouch assembly is disposed within a hand pouch and has at least one access point to a storage area of the concealed pocket. The concealed pocket system enables users to securely store items in the clothing garment, while effectively hiding points of access to the storage area of the concealed pocket, thereby providing an additional layer of security.

1 Claim, 5 Drawing Sheets

CONCEALED POCKET SYSTEM

CROSS REFERENCE

This application is a continuation-in-part and claims benefit of U.S. patent application Ser. No. 14/989,111 filed Jan. 6, 2016, which is a continuation-in-part and claims benefit of U.S. patent application Ser. No. 13/627,234 filed Sep. 26, 2012, which is a continuation-in-part and claims benefit of U.S. patent application Ser. No. 12/775,434 filed May 6, 2010, the specification(s) of which are incorporated herein in their entirety by reference.

FIELD OF THE INVENTION

The present invention relates to clothing garments having a concealed pocket.

BACKGROUND OF THE INVENTION

Clothing, such as shirts, sweatshirts, hooded pullover sweatshirts (hoodies), sweaters, jackets, and vests, often do not have adequate means for users to store items such as keys, wallets, phones, or music devices. While these clothing may have pockets, the pockets usually have permanent openings. As a result, items tend to fall out of these articles of clothing and become lost. While some pockets may be equipped with a sealable opening, they are still clearly visible on the garment, which can unfortunately provide pickpocketers with easy access to the pockets from which they can steal the items within.

There have been solutions to mitigate the problems described above. For example, US20080196140A1 of Mayerson teaches a front pocket located behind a front pouch and having an opening just above the front pouch (FIG. 7). As another example, US20090282600A1 of Robinson teaches a pocket assembly having a means for closing a topside (FIG. 8). Further still, US20050235398A1 of Yoo discloses a pocket system having an inlet to access the passageway of the pocket system (FIG. 9). However, while these prior arts teach concealed pockets, they are still prone to pickpocketing due to their exposed closure means.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a concealed pocket system garments. Examples of said garments include, but are not limited to shirts, sweatshirts, hoodies, sweaters, jackets, and vests. The present invention provides a secure means for users to store items. Without wishing to limit the invention to any theory or mechanism, the present invention's structure not only allows multiple access points to the storage space for convenience, but it also hides these access points from the public eye, effectively adding another layer of security from theft. None of the presently known prior references or work has the unique inventive technical feature of the present invention.

Further still, the systems of Mayerson and Robinson, if combined, would not arrive at the present invention. The front pouch of Mayerson, when overlaid on the pocket subassembly of Robinson, would obviate access to the pocket flap opening of Robinson.

In a non-limiting embodiment, the concealed pocket system comprises a torso-covering garment surface having a concealed pocket assembly disposed thereon. The concealed pocket assembly may comprise a concealed pocket, a hand pouch, and a first zipper configured to provide access to the concealed pocket. In some embodiments, the concealed pocket has a concealed pocket top edge and a concealed pocket bottom edge. In some embodiments, the hand pouch has a hand pouch top edge and a hand pouch bottom edge. Preferably, the hand pouch top edge, the concealed pocket top edge, and a first side of the zipper may be permanently attached together by stitching in said order. A second side of the zipper may also be permanently attached to the garment surface by stitching. This arrangement sandwiches the first zipper between the concealed pocket and the garment surface, thus effectively hiding the first zipper from view. In other embodiments, the concealed pocket top edge is aligned with the hand pouch top edge. In still other embodiments, the hand pouch bottom edge is aligned with the concealed pocket bottom edge but overlaps the ends of the concealed pocket bottom edge. Preferably, the concealed pocket is disposed between the hand pouch and garment surface so as to be hidden from view. Said configurations effectively provide enough space for users to access the concealed pocket while also hiding access points to the concealed pocket through the first zipper and a second zipper disposed on the concealed pocket.

In accordance with the present invention, the concealed pocket system has been described for exemplary purposes, in connection with pullover sweatshirts. However, the concealed pocket system may be used with any torso-covering garment.

BRIEF DESCRIPTION OF THE DRAWINGS

The features and advantages of the present invention will become apparent from a consideration of the following detailed description presented in connection with the accompanying drawings in which:

FIG. 6A shows the concealed pocket assembly being attached to a garment. FIG. 6B shows the concealed pocket being attached to a garment. FIG. 6C shows a concealing pouch being attached to the garment to cover the concealed pocket.

DESCRIPTION OF PREFERRED EMBODIMENTS

Figure 1:
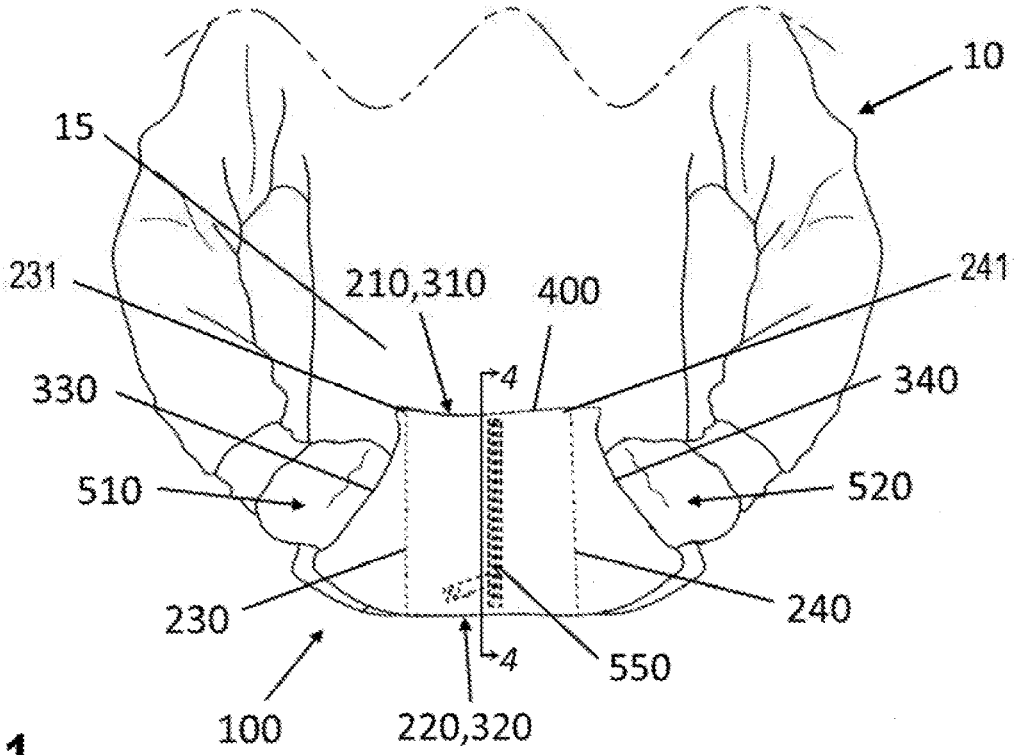
FIG. 1 shows a front view of the concealed pocket system of the present invention.

The following is a list of elements corresponding to a particular element referred to herein:

10 torso-covering garment or pullover sweatshirt

15 torso garment surface or front sweatshirt surface
100 concealed pocket system
200 concealed pocket assembly
205 concealed pocket
210 concealed pocket top edge
230, 240 concealed pocket first side edge, concealed pocket second side edge
231, 241 intersection of the concealed pocket top edge and conceal pocket first side edge, intersection of the concealed pocket top edge and the concealed pocket second side edge.
240 concealed pocket second side edge
250 first stitching
300 hand pouch
310 hand pouch top edge
320 hand pouch bottom edge
330 hand pouch first side edge
340 hand pouch second side edge
350 second stitching
360 interior compartment of hand pouch
400 first zipper
410, 401 first zipper side, first zipper end
415 first row of zipper teeth
420, 402 second zipper side, second zipper end
425 second row of zipper teeth
430 zipper slider
450 third stitching
460 fourth stitching
500 slit
510 first hand slot
520 second hand slot
550 second zipper Referring now to FIG. 1-6C, in one embodiment, the present invention features a concealed pocket system (100) for a torso-covering garment (10). Examples of the torso-covering garment (10) include, but are not limited to, shirts, sweaters, jackets, vests, or sweatshirts. Further still, the torso-covering garment (10) may optionally have a hood.

Figure 5:
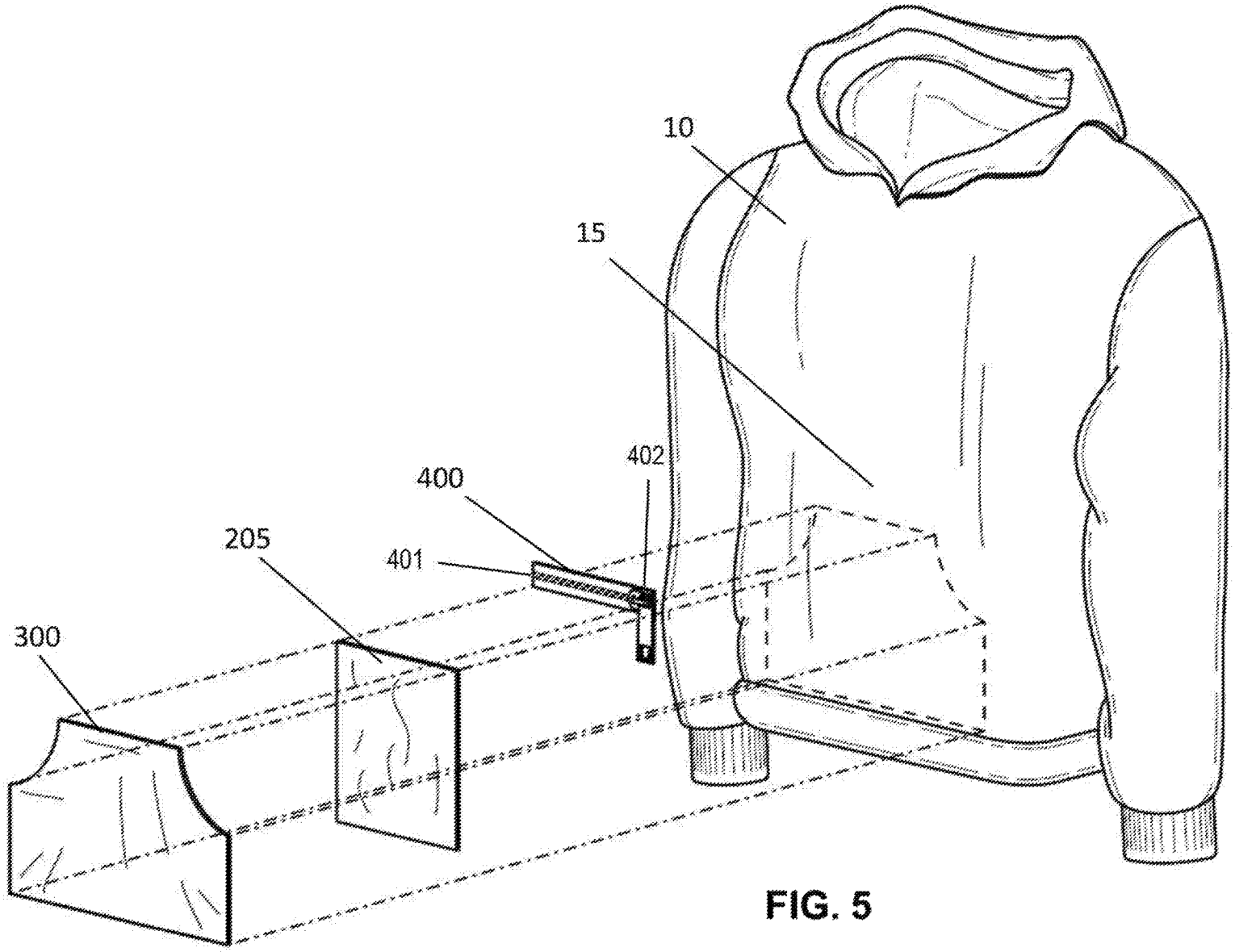
FIG. 5 shows an exploded view of the concealed pocket system.

In an exemplary embodiment, as shown in FIG. 5, the concealed pocket system (100) may comprise a torso garment surface (15) of the torso-covering garment (10) and a concealed pocket assembly (200). In one embodiment, the concealed pocket assembly (200) may comprise a concealed pocket (205) constructed from a rectangular-shaped cloth, a hand pouch (300) constructed from a cloth having six sides including two curved sides, and a first zipper (400). Without wishing to limit the invention to a particular arrangement, the concealed pocket (205) may be disposed between the torso garment surface (15) and the hand pouch (400) such that the concealed pocket (205) is hidden within the hand pouch (400) and concealed from view.

In some embodiments, the concealed pocket (205) may comprise a concealed pocket top edge (210), a concealed pocket bottom edge (220), a concealed pocket first side edge (230), and a concealed pocket second side edge (240). The concealed pocket bottom edge (220), the concealed pocket first side edge (230), and the concealed pocket second side edge (240) may be permanently attached to the torso garment surface (15) via a first stitching (250), as shown in FIG. 6B.

Figure 4:
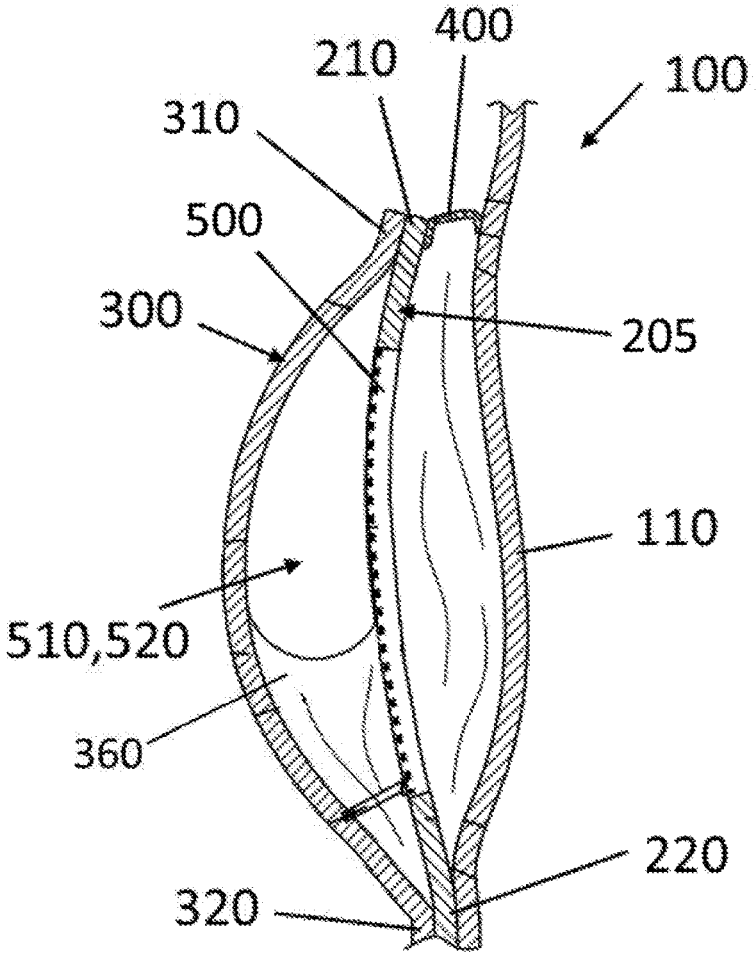
FIG. 4 shows a cross-sectional view of the concealed pocket system taken along the line in FIG. 1.

In other embodiments, the hand pouch (300) may comprise a hand pouch top edge (310), a hand pouch bottom edge (320), a hand pouch first side edge (330), and a hand pouch second side edge (340). Preferably, the hand pouch bottom edge (320) may be aligned with the concealed pocket bottom edge (220) and overlap the ends of the concealed pocket bottom edge (220) such that the concealed pocket bottom edge (220) is sandwiched between the hand pouch bottom edge (320) and the torso garment surface (15), as shown in FIG. 4.

In preferred embodiments, the hand pouch (300) is sufficiently sized so as to completely hide the concealed pocket (205) from view. In some embodiments, the hand pouch top edge (310) may be at least equal in length to the concealed pocket top edge (210). For example, the hand pouch top edge (310) is longer than the concealed pocket top edge (210). Alternatively, the hand pouch top edge (310) may be equal in length to the concealed pocket top edge (210). In other embodiments, the hand pouch bottom edge (320) is preferably longer than the concealed pocket bottom edge (220). In further embodiments, the concealed pocket first and second side edges (230, 240) may be at most equal in length to the hand pouch first and second side edges (330, 340). More preferably, the concealed pocket first and second side edges (230, 240) may be shorter than the hand pouch first and second side edges (330, 340).

Figure 6A:
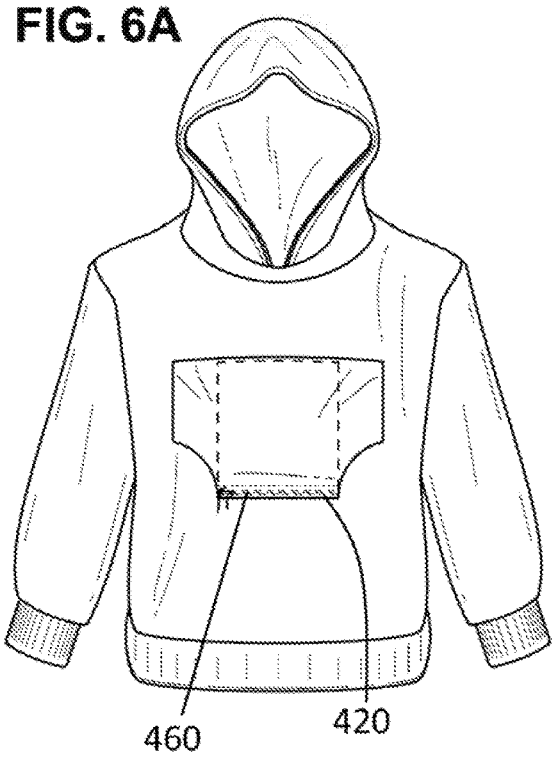
FIGS. 6A-6C illustrates the construction of the concealed pocket system.
Figure 6B:
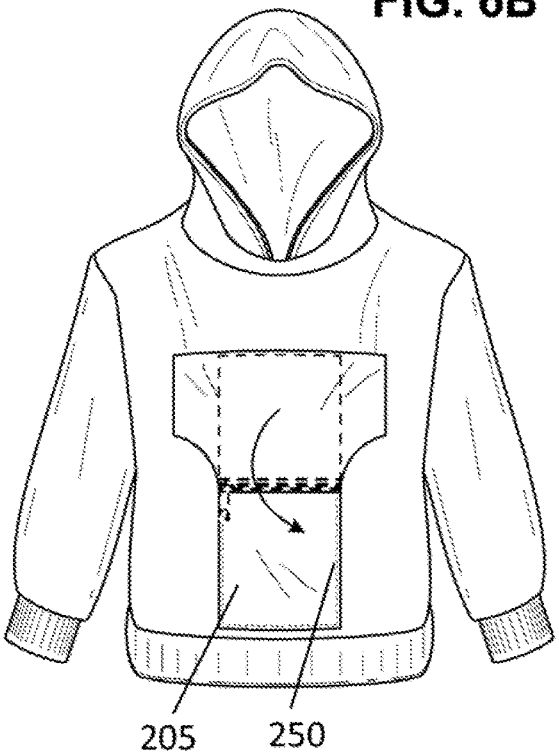
Figure 6C:
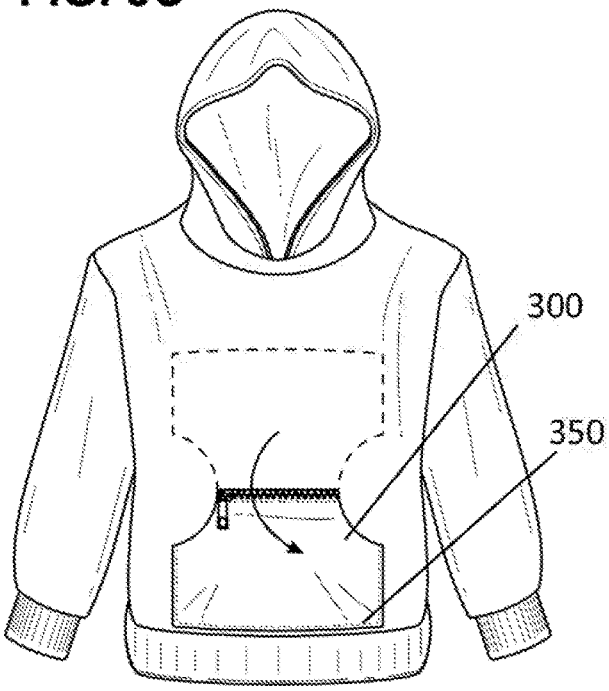
Figure 7:
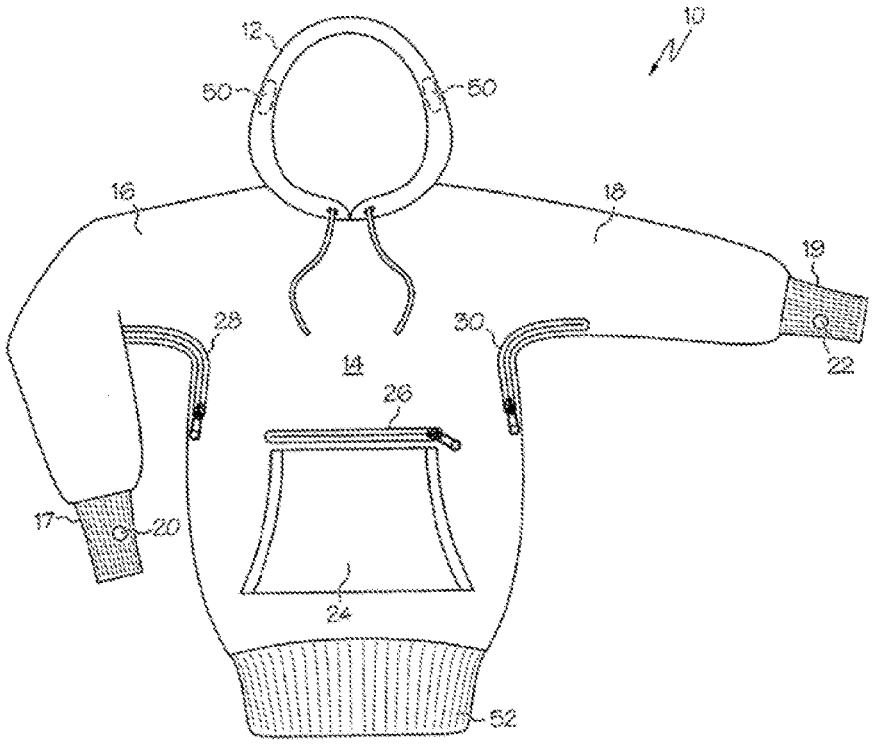
FIG. 7 (prior art)
FIGS. 7-9 show the concealed pocket systems of prior arts.
Figure 8:
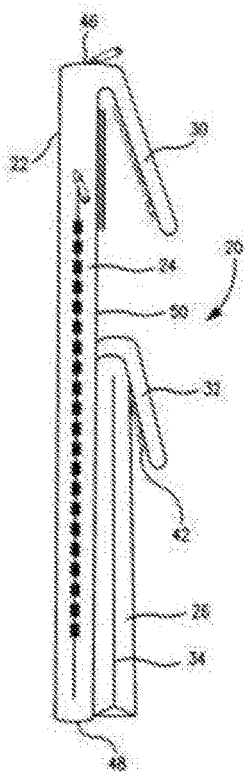
FIG. 8 (prior art)
Figure 9:
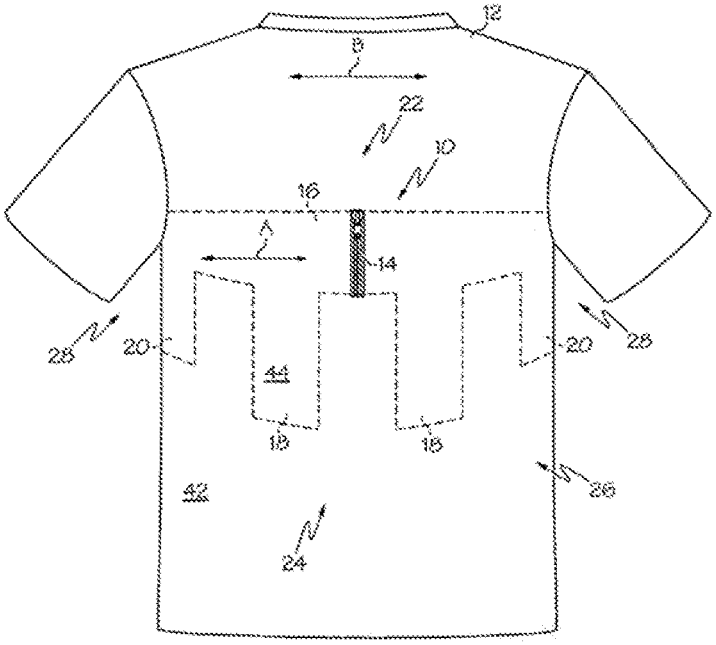
FIG. 9 (prior art)

In one embodiment, the hand pouch bottom edge (320), a portion of the hand pouch first side edge (330) near the hand pouch bottom edge (320), and a portion of the hand pouch second side edge (340) near the hand pouch bottom edge (320) may be permanently attached to the torso garment surface (15) via a second stitching (350), as shown in FIG. 6C. In another embodiment, the remaining unattached portion of the hand pouch first side edge (330) can form a first hand slot (510). Similarly, the remaining unattached portion of the hand pouch second side edge (340) can form a second hand slot (520).

In alternative embodiments, the entire hand pouch first side edge (330) and the entire hand pouch second side edge (340) may not be stitched to the garment surface (15). For example, only the hand pouch bottom edge (320) may be permanently attached to the torso garment surface (15) via the second stitching (350). Thus, the entire hand pouch first side edge (330) can form the first hand slot (510), and the entire hand pouch second side edge (340) can form the second hand slot (520).

Referring to FIG. 1, an example of the concealed pocket system (100) is shown. The first hand slot (510) and second hand slot (520) allows the user to rest his/her hands within the hand pouch. In some embodiments, an interior pouch compartment (360) of the hand pouch (300) is only accessible through the first hand slot (510) and the second hand slot (520). The dotted lines outline the concealed pocket (205) hidden behind the hand pouch (300).

Figure 2:
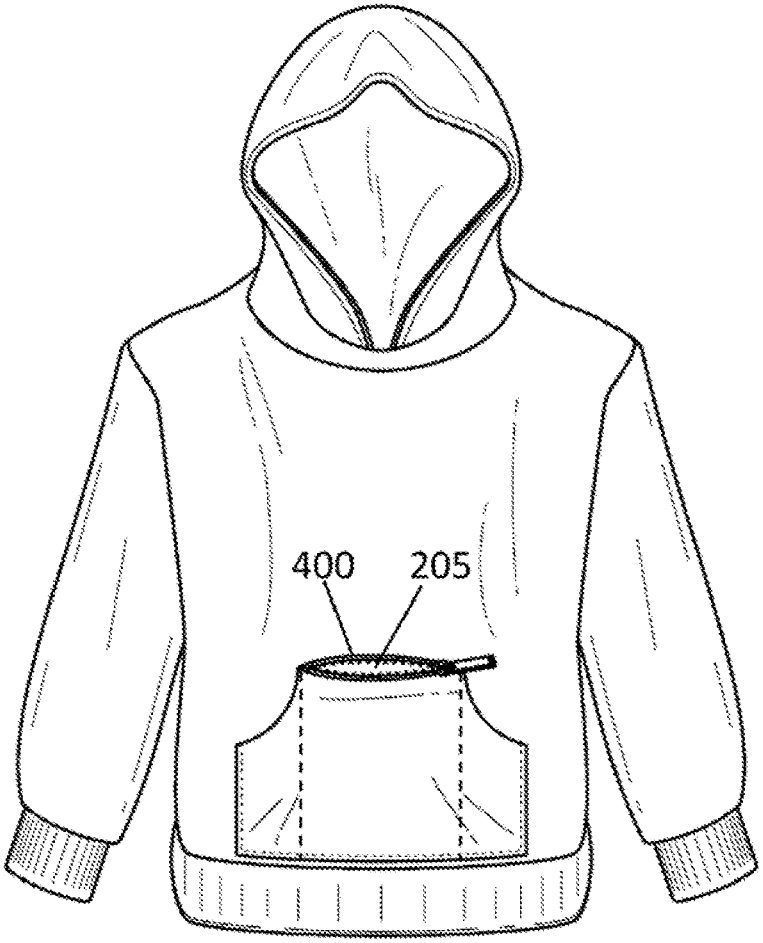
FIG. 2 shows another embodiment of the concealed pocket of the system in an opened configuration.

In another embodiment, the first zipper (400) may comprise a first zipper side (410) having a first row of zipper teeth (415), a second zipper side (420) having a second row of zipper teeth (425), and a zipper slider (430). One of ordinary skill in the art will understand that the zipper slider (430) is configured to interlock the first row of zipper teeth (415) with the second row of zipper teeth (425) and to separate the interlocked first and second rows of zipper teeth (415, 425), as shown in FIG. 2.

Figure 3:
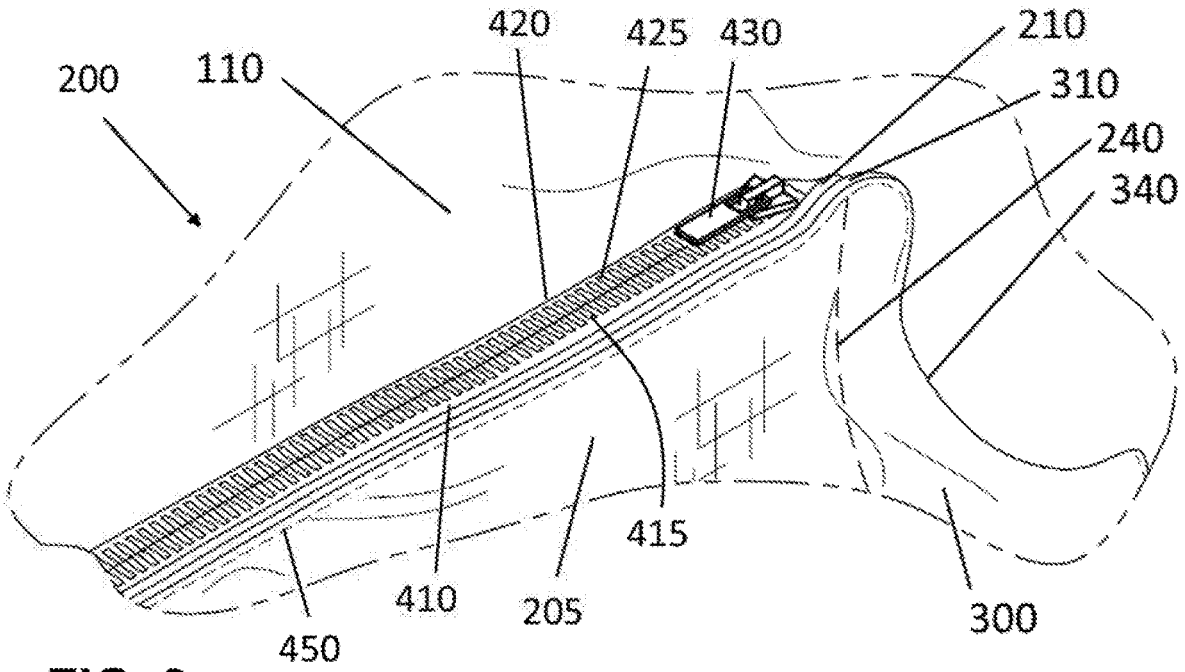
FIG. 3 shows a close-up view of a concealed pocket closure.

Referring to FIG. 3, an example of the first zipper (400) relative to the other components is shown. In one embodiment, the first zipper side (410), the concealed pocket top edge (210), and the hand pouch top edge (310) may be permanently attached to each other via a third stitching (450). Because the hand pouch top edge (310) is attached to the concealed pocket (205) at the concealed pocket top edge (210) and further aligned with the concealed pocket top edge (210), the first zipper (410) is hidden from front view.

Referring to FIG. 6A, the second zipper side (320) may be permanently attached to the torso garment surface (15) via a fourth stitching (460).

In further embodiments, the concealed pocket (205) may also have a slit (500) centrally disposed thereon and parallel to the concealed pocket first side edge (230) and the concealed pocket second side edge (240). Preferably, the slit (500) is hidden within the hand pouch (400) and concealed from view. In one embodiment, the slit may be temporarily sealed by a second zipper (550). The second zipper (550) can be accessed through the first hand slot (510) or through the second hand slot (520). The second zipper (550) is preferably oriented perpendicular to the first zipper (400) to allow for ease of access since a hand entering any of the hand slots is usually oriented parallel to the torso. An embodiment of the concealed pocket (205) having the slit (500) with the second zipper (550) is shown in FIG. 1. However, another embodiment of the concealed pocket (205) without the slit (500) or the second zipper (550) is shown in FIG. 2.

Preferably, as shown in FIG. 4, the concealed pocket top edge (210) is sandwiched between the hand pouch top edge (310) and the first zipper side (410) such that the first zipper (400) is disposed between the concealed pocket (205) and the torso garment surface (15), thus concealing the first zipper (400) from view. Also shown in FIG. 4 is the location of both the first zipper (400) and the second zipper (500). Two points of access to the pocket storage area are available. In addition, because the hand pouch (300) overlays the concealed pocket (205), the second zipper is completely hidden from view.

In alternatively embodiments, the first and/or second zippers may be replaced by a hook and loop closure mechanism. For instance, a strip of the hook or loop side is permanently attached to the garment surface via the fourth stitching, while the opposing strip (i.e. loop or hook side) is permanently attached to the concealed pocket top edge (210) and the hand pouch top edge (310) via the third stitching.

In one embodiment, the rectangular-shaped cloth of the concealed pocket and the six sided cloth of the hand pouch may be formed from the same cloth material. For example, both cloth may be made from a cotton, polyester, or mixed fabric. Alternatively, the rectangular-shaped cloth and the six sided cloth may be formed from different cloth materials. In preferred embodiments, the concealed pocket and hand pouch are similar or identical in color and/or pattern. More preferably, the garment, the concealed pocket, the hand pouch, and the zippers are similar or identical in color and/or pattern, thus further concealing the pocket and zippers from view by blending into the garment and the hand pouch.

In accordance with previous embodiments, the present invention may also feature a pullover sweatshirt (10) having a continuous front sweatshirt surface (15) and any one of the concealed pocket assemblies (200) described herein. Preferably, the concealed pocket assembly (200) may be disposed on the front sweatshirt surface (15). In further embodiments, the pullover sweatshirt (10) may optionally have a hood, thus forming a hooded pullover sweatshirt or "hoodie".

In accordance with previous embodiments, the present invention may further feature a pullover sweatshirt (10) consisting of a torso-covering garment surface (15), a hood, and a concealed pocket assembly (200) disposed on said torso-covering garment surface (15). The concealed pocket assembly (200) may be according to any of the embodiments described herein. For instance, in one embodiment, the concealed pocket assembly (200) may consists of a concealed pocket (205) constructed from of a rectangular-shaped cloth, a hand pouch (300) constructed from a cloth having six sides including two curved sides, and a first zipper (400) consisting of a first zipper side (410), a first row of zipper teeth (415) disposed on the first zipper side (410), a second zipper side (420), a second row of zipper teeth (425) disposed on the second zipper side (420), and a zipper slider (430). Said components of the concealed pocket assembly can be attached to the torso-covering garment surface (15) via stitching as previously described. Preferably, the concealed pocket (205) is disposed between the torso-covering garment surface (15) and the hand pouch (400) such that the concealed pocket (205) is hidden within the hand pouch (400) and concealed from view. Further preferred is the first zipper (400) disposed between the concealed pocket (205) and the torso-covering garment surface (15) such that the first zipper (400) is also concealed from view.

As used herein, the term "about" refers to plus or minus 10% of the referenced number.

The disclosures of the following U.S. Patent Applications are incorporated in their entirety by reference herein: U.S. Pat. No. US20080196140A1, US20090282600A1, and US20050235398A1.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pullover sweatshirt (10) consisting of a torso-covering garment surface (15), a hood, two sleeves, two sleeve cuffs, a waistband, a torso portion, and a concealed pocket assembly (200) disposed on said torso-covering garment surface (15), wherein the concealed pocket assembly (200) consists of:

a) a concealed pocket (205) constructed from a rectangular-shaped cloth, wherein a concealed pocket bottom edge (220), a concealed pocket first side edge (230), and a concealed pocket second side edge (240) of the concealed pocket (205) are permanently attached to the torso-covering garment surface (15) via a first stitching (250);

b) a hand pouch (300) constructed from a cloth having six sides including two curved side, wherein a hand pouch bottom edge (320) of the hand pouch (300) overlaps the concealed pocket bottom edge (220) such that the concealed pocket bottom edge (220) is sandwiched between the hand pouch bottom edge (320) and the torso-covering garment surface (15), wherein the hand pouch bottom edge (320), a portion of a hand pouch first side edge (330) of the hand pouch (300), and a portion of a hand pouch second side edge (340) of the hand pouch (300) are permanently attached to the torso-covering garment surface (15) via a second stitching (350), wherein a remaining unattached portion of the hand pouch first side edge (330) forms a first hand slot (510) and a remaining unattached portion of the hand pouch second side edge (340) forms a second hand slot (520); and c) a first zipper (400) consisting of a first zipper end (401), a second zipper end (402), a first zipper side (410), a first row of zipper teeth (415) disposed on the first zipper side (410), a second zipper side (420), a second row of zipper teeth (425) disposed on the second zipper side (420), and a zipper slider (430);

wherein the first zipper end (401) is disposed at an intersection (231) of a concealed pocket top edge (210) and the concealed pocket first side edge (230), wherein the second zipper end (402) is disposed at an intersection (241) of a concealed pocket top edge (210) and the concealed pocket second side edge (240), wherein the zipper slider is configured to interlock the first row of zipper teeth (415) with the second row of zipper teeth (425) and to separate the interlocked first and second rows of zipper teeth (415, 425), wherein the first zipper side (410), a concealed pocket top edge (210) of the concealed pocket (205), and a hand pouch top edge (310) of the hand pouch (300) are permanently attached to each other via a third stitching (450) such that the concealed pocket top edge (210) is sandwiched between the hand pouch top edge (310) and the first zipper side (410), wherein the second zipper side (420) is permanently attached to the torso-covering garment surface (15) via a fourth stitching (460) such that the first zipper (400) is sandwiched between the concealed pocket (205) and the torso-covering garment surface (15);

wherein the concealed pocket top edge (210) is aligned with the hand pouch top edge (310), wherein the hand pouch top edge (310) is at least equal in length to the concealed pocket top edge (210), wherein the hand pouch bottom edge (320) is longer than the concealed pocket bottom edge (220), wherein the concealed pocket first and second side edges (230, 240) are at most equal in length to the hand pouch first and second side edges (330, 340), wherein the concealed pocket (205) is disposed between the torso-covering garment surface (15) and the hand pouch (400) such that the concealed pocket (205) is hidden within the hand pouch (400) and concealed from view, wherein an interior pouch compartment (360) of the hand pouch (300) is only accessible through the first hand slot (510) and the second hand slot (520), and wherein the first zipper (400) is disposed between the concealed pocket (205) and the torso-covering garment surface (15).

* * * * *